United States Patent [19]

Young, Jr.

[11] 4,322,026

[45] Mar. 30, 1982

[54] METHOD AND APPARATUS FOR CONTROLLING A MOVING WEB

[75] Inventor: William O. Young, Jr., Spartanburg, S.C.

[73] Assignee: Young Engineering, Inc., Spartanburg, S.C.

[21] Appl. No.: 139,994

[22] Filed: Apr. 14, 1980

[51] Int. Cl.[3] ..... B65H 25/26; B65H 23/02; B65H 17/32

[52] U.S. Cl. ..... 226/15; 226/3; 226/97

[58] Field of Search ..... 226/15, 3, 16, 17, 19, 226/21, 22, 97, 108; 271/227, 251; 26/51.5

[56] References Cited

U.S. PATENT DOCUMENTS

| | | | |
|---|---|---|---|
| 2,848,820 | 8/1958 | Wallin | 34/23 |
| 2,883,475 | 4/1959 | Ridler | 179/100.2 |
| 2,970,638 | 4/1957 | Wockenfuss | 271/2.1 |
| 2,989,265 | 6/1961 | Selsted | 242/76 |
| 3,075,679 | 1/1963 | Wadey | 226/108 |
| 3,142,870 | 8/1964 | Nydam | 19/231 |
| 3,159,170 | 12/1964 | Callon | 226/15 X |
| 3,192,845 | 7/1965 | Schmidt | 95/89 |
| 3,231,165 | 1/1966 | Wallin | 226/97 |
| 3,272,415 | 9/1966 | Wallin | 226/97 |
| 3,290,795 | 12/1966 | Jarreby | 34/122 |
| 3,431,602 | 3/1969 | Appel | 19/66 |
| 3,570,735 | 3/1971 | Kurz | 226/1 |
| 3,632,030 | 1/1972 | Cohn | 226/3 |
| 3,650,043 | 3/1972 | Overly | 34/156 |
| 3,719,315 | 3/1973 | Zuber | 226/97 |
| 3,759,457 | 9/1973 | Edes | 226/19 |
| 3,779,438 | 12/1973 | Nilsson | 226/19 |
| 3,971,496 | 7/1976 | Karsh | 226/15 |
| 4,068,789 | 1/1978 | Young | 226/3 |

*Primary Examiner*—Edward J. McCarthy
*Attorney, Agent, or Firm*—Luke J. Wilburn, Jr.; Wellington M. Manning, Jr.; John B. Hardaway, III

[57] ABSTRACT

Method and apparatus for smoothing and laterally guiding a longitudinally moving web of material wherein the web is longitudinally moved in a generally upward vertical direction past first pressurized fluid discharge manifolds disposed adjacent the web path on either side of the plane of the web to continuously direct streams of pressurized fluid, such as air, outwardly of the central portion of the web and toward side edges of the web to smooth and remove wrinkles from the same, and second pressurized fluid discharge manifolds located adjacent at least side edge portions of the web path for intermittently directing streams of air across opposite faces of the web toward one or the other of the side edges thereof, in response to web edge sensing means, to laterally move and guide the web during its longitudinal travel.

16 Claims, 5 Drawing Figures

METHOD AND APPARATUS FOR CONTROLLING A MOVING WEB

This invention relates to method and apparatus for controlling the position of a moving web of material, and, more particularly, to improved method and apparatus for guiding and smoothing a thin, lightweight web of material during its longitudinal movement in a desired path of travel.

BACKGROUND OF THE INVENTION

It is a common practice in manufacturing operations involving indefinite length web materials to longitudinally transport the web in a desired path of travel for processing and/or collection. Typically in textile manufacturing operations, textile fabrics in indefinite length form are longitudinally moved in a path of travel for treatment, inspection, and/or collection in roll form. In such web handling operations, it is generally desirable and often essential that the web be precisely positioned during its longitudinal movement to ensure proper processing and roll formation during collection.

Various mechanical devices have been employed to engage the surface of a web and spread it to full width during its longitudinal movement, and other mechanical devices have been used to selectively engage and adjust the lateral position of a web during its movement in response to edge-sensing means. Bowed support rolls are commonly employed to laterally spread a web during its longitudinal movement, and mechanical guide elements located adjacent side edges of the path of travel of the web are employed to selectively engage the web in response to web edge-sensing means to laterally displace and ensure accurate location of the same during its longitudinal movement. One apparatus for controlling the lateral position of a moving web is disclosed in Young et al U.S. Pat. No. 4,068,789 and comprises a scroll roll having a pair of pressure applicators located adjacent side portions of the roll which are selectively movable into contact with the web in response to edge-sensing means to press the web against the scroll roll surface and cause lateral displacement of the web along the roll in desired direction. The patent discloses in one embodiment that a pressurized stream of air may be directed against the surface of the web to press it more firmly against the scroll roll such that the roll moves the web laterally to the right or left in response to edge sensing means.

It is also known to employ pressurized air to convey and/or smooth selected portions of a moving web of material during a web processing or web collection operation. The following U.S. Pat. Nos. disclose various apparatus utilizing pneumatic pressure for such purpose: 2,790,638 2,848,820 2,883,475 2,989,265 3,075,679 3,142,879 3,192,845 3,231,165 3,272,415 3,290,795 3,431,602 3,650,043 3,719,315

In the handling and processing of fragile or lightweight web constructions, such as flimsy, lightweight gauze fabrics and non-woven materials, it is difficult to accurately control the position of such webs in running length form by use of conventional mechanical spreading and guiding equipment which contact the web surface. Often the mechanical guide elements contacting the web will tear, snag, distort, or otherwise damage the web, and often are ineffective for properly positioning the web for processing or collection.

BRIEF OBJECTS OF THE INVENTION

It is therefore an object of the present invention to provide improved method and apparatus for handling and accurately positioning a web of material during its longitudinal movement for processing or collection, and which method and apparatus is particularly suited for handling lightweight or fragile web materials.

It is another object to provide a method and apparatus for rapidly and accurately laterally positioning a web of material during its longitudinal movement without contact of the surface of the web with mechanical elements during positioning.

It is a more specific object to provide method and apparatus for acting on a web of material during its longitudinal movement by the use of pressurized streams of fluid which are directed across the surface of the web to continuously smooth and selectively laterally position the same during its passage thereby.

It is a further specific object to provide method and apparatus for handling a flimsy, lightweight web of material to smooth and laterally position the same during its longitudinal movement, and without contact of the surface of the web with mechanical surfaces which may detrimentally effect the web.

It is a further object of the invention to provide method and apparatus for directing a longitudinally moving indefinite length web of material to a point of collection on a take up roll, while accurately smoothing and laterally positioning the web immediately prior to its take up to provide more uniform and precise collection thereof in roll form.

SUMMARY OF THE INVENTION

Briefly the apparatus of the present invention comprises means for intermittently directing pressurized streams of fluid, such as air, transversely across the surface of a longitudinally moving web of material and selectively toward one or the other of the side edges of the web to correspondingly move the web laterally in its longitudinal path of travel. Web detection means located adjacent the web path are employed to selectively activate the streams of air in response to the detected lateral position of the web, thereby maintaining the web in a proper lateral alignment in its path of travel for further processing and/or collection. The invention also includes, as a combination embodiment with the aforementioned lateral positioning means, further fluid pressure means for continuously directing streams of air laterally outwardly of a central portion of the web simultaneously toward both side edges of the web to spread and smooth the same during its longitudinal travel. Preferably, for lightweight or flimsy web materials, the web is directed in a vertically upward direction so that it hangs in relaxed, free condition for lateral guidance and smoothing by the fluid applicator means.

In one embodiment of the present invention, pressurized streams of fluid are applied across opposed surfaces of the web from elongate fluid discharge manifold means having a plurality of fluid discharge outlets angularly directed to discharge pressurized fluid, such as air, continuously toward both side edges of the web away from the center of the web to smooth and spread the web, while second pressurized fluid discharge manifold means located adjacent the web path and overlying at least edge portions of the web intermittently direct pressurized streams of fluid outwardly toward the edges to laterally displace the web in a desired direction in response to control by a web position-detecting device, such as a photoelectric sensing device, located adjacent an edge of its path of travel.

BRIEF DESCRIPTION OF THE DRAWINGS

The above as well as other objects of the present invention will become more apparent, and the invention will be better understood from the following detailed description of preferred embodiments thereof, when taken in connection with the accompanying drawings, in which.

DETAILED DESCRIPTION OF PREFERRED EMBODIMENTS

Figure 1:
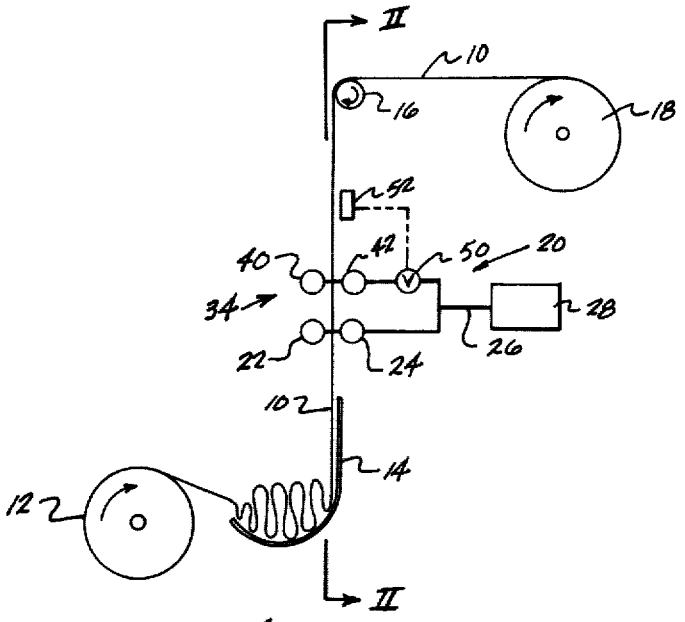
FIG. 1 is a schematic side elevation view of web handling apparatus incorporating novel features of the present invention for smoothing and laterally guiding a moving web of material prior to its collection in roll form.

Referring more specifically to the drawings, FIG. 1 shows schematically, in side elevation view, apparatus for smoothing and guiding an indefinite length of web material during its longitudinal movement in a desired path of travel. As seen, an indefinite length web of material, such as a lightweight woven gauze fabric 10 is supplied from a suitable source, such as a roll 12, into a scray-type accumulator 14. Web 10 passes upwardly from the accumulator 14 in a vertical direction over a support roll or guide bar 16 and thereafter is collected on a suitably driven collection roll 18.

Figure 2:
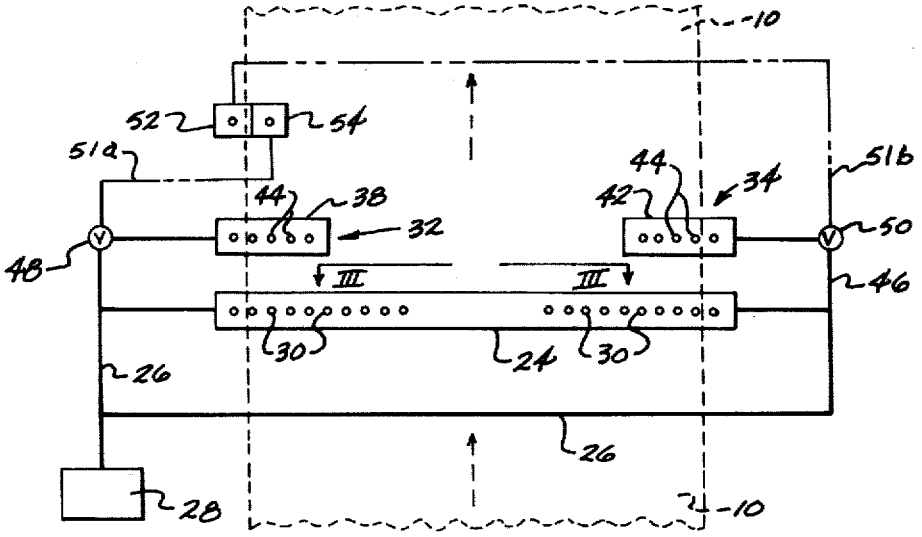
FIG. 2 is a sectional view of a portion of the apparatus, taken generally along line II—II of FIG. 1 and illustrating the fluid pressure manifolds for smoothing and laterally guiding the web in its longitudinal path of travel.
Figure 3:
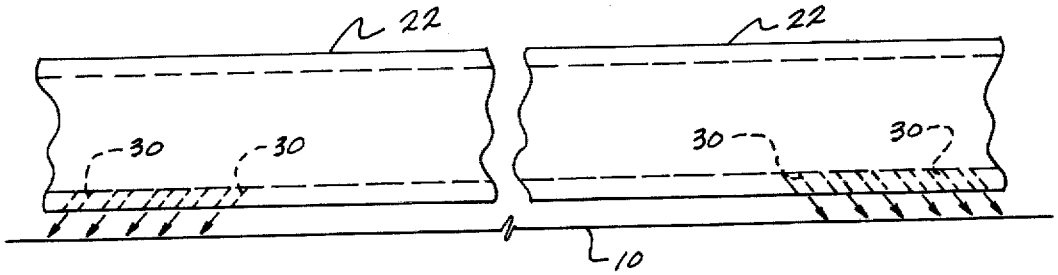
FIG. 3 is an enlarged broken away view of a portion of one of the pressurized fluid distributing manifolds of FIG. 2 looking in the direction of arrows III—III therein and showing the angular disposition of the fluid discharge outlets of the manifold.

Positioned adjacent the vertical path of travel of the web to collection roll 18 are fluid pressure means, generally indicated at 20, for smoothing and laterally guiding the web durings its movement. As seen in FIGS. 1 and 2, fluid pressure means 20 is illustrated as a first pair or set of elongate manifold pipes 22, 24 which extend across the full width of the web path on opposite sides of the plane of the web. Each manifold pipe is connected at its ends by a conduit 26 to a pressurized fluid supply source, such as an air compresser or blower fan 28. Located in spaced relation along the length of each of the pipes in the facing wall portions thereof are a plurality of fluid discharge outlets 30. As best seen in FIG. 3, the discharge outlets 30 in each manifold pipe are positioned with their discharge axes angled so as to direct streams of pressurized air outwardly of a central portion of the web path and across the opposed web surfaces toward opposite side edges of the web. As seen in FIG. 3, which is an enlarged broken away central portion of one of the manifold pipes 22, the discharge outlets 30 may be formed by passageways drilled into the wall of the pipe at an appropriate angle, such as 45°, to the surface of the web 10, with the outlets on the left portion from the center of the pipe, as seen in FIG. 2, directed toward the left edge of the web, and the outlets on the right portion from the center of the pipe directed toward the right edge of the web, such that the air streams move outwardly across the web surface from the center toward the side edges in a direction generally perpendicular to its longitudinal movement to spread and smooth the web laterally and remove any wrinkles or creases which may be imposed therein.

Located just above and downstream of the pair of smoothing manifold pipes 22, 24 in the path of vertical movement of the web 10 are web-guiding means, illustrated as two sets of pressurized fluid manifolds 32, 34 (FIG. 2) which span opposite side edge portions of the web path. Each set 32, 34 includes a pair of shorter manifold pipes, three of which 38, 40 and 42 are seen in FIGS. 1 and 2. The pairs of pipes of each set 32, 34 are located in opposed relation on opposite sides of the plane of the web 10. As with the smoothing manifold pipes 22, 24, the pairs of edge-guiding manifold pipes also are provided with air discharge outlets 44 disposed in facing wall portions thereof and at an appropriate angle to direct streams of air across the adjacent web surface transversely to the longitudinal direction of movement of the web and toward the adjacent side edges of the web. The pipes of each set 32, 34 of manifolds are connected by conduits 46, 26 to the air blower fan 28, and suitable control valve means, such as solenoid valves 48, 50, are located in conduit lines 46 to control flow of pressurized air to the respective sets 32, 34. As seen in FIGS. 1 and 2, each of the control valves 48, 50 is electrically connected by wiring 51*a*, 51*b* to web edge detection means, illustrated as a pair of photoelectric cells 52, 54 positioned adjacent an edge portion of the path of travel of web 10 downstream of manifold sets 32, 34.

The air manifold pipes for smoothing and laterally guiding the web, as well as the photoelectric web-edge detection device are supported by suitable adjustable support members (not shown) to locate them in desired position adjacent the vertical path of travel to accommodate the particular width of web material passing from accumulator 14.

In operation, and referring to FIGS. 1 and 2, as the web 10 passes in vertical direction to the collection roll 18, air is supplied continuously to the smoothing manifold pipes 22, 24 from the fan 28 to direct streams of air outwardly of the central portion of the web and across the surface to opposite side edges thereof, thereby smoothing and removing wrinkles or creases which may be present in the web when it leaves the accumulator. For edge guidance, if the photoelectric cell 52 detects the presence of the edge portion of the web, an electrical signal is transmitted by suitable timing means to momentarily open solenoid valve 50 and discharge a short pulse of air from the manifold pipes of set 34 toward the right hand side edge of the web to laterally move the web a short distance to the right in its path of longitudinal travel, as seen in FIG. 2. In like manner, if photoelectric cell 54 detects an absence of the edge portion of the web, an electrical signal is transmitted by suitable timing means to momentarily open solenoid valve 40 and discharge a short pulse of air from the manifold pipes of set 32 to move the web laterally to the left in its longitudinal path of travel, as seen in FIG. 2. Thus the edge of the web during its travel is continuously maintained in a path of travel between the two photoelectric cells 52, 54, thereby maintaining correct lateral position of the web as it is collected on collection roll 18.

By directing the web in a vertical path of travel from the accumulator to the collection roll during smoothing and edge guidance, the web hangs freely, in relaxed condition, without contact with support guides or rolls, so that the web is free to be smoothed and laterally moved with minimal air pressures directed against the web surface.

Although the fluid pressure manifolds have been shown as multiple pipes having drilled fluid discharge outlets, the manifolds and discharge outlets may be take various shapes and constructions. For example, the smoothing and lateral guiding fluid discharge manifolds located on each side of the planes of the path of the web may be enclosed, or formed within a single housing or unit extending across the web path and located in opposed relation adjacent opposite faces of the web. Similarly, the discharge outlets for intermittent application of air for lateral guidance of the web may be located upstream in the web path from the web smoothing discharge outlets, or a series of such smoothing and lateral guiding discharge outlets may be spaced along the longitudinal path of movement of the web, with the respective discharge outlets being connected by suitable conduit means to the pressurized air source, and with air supply to the lateral guiding outlets being controlled by suitable valve means actuated in response to the web-edge detection means, as hereinbefore described.

Although the control valves for intermittently supplying air to the edge-guiding manifolds have been described as electrically operated solenoid valves, other control valve arrangements may be employed. The control valves may preferably be conventional off/on valves operated by conventional stepping motors which are electrically actuated by signals from the web-edge detecting device. The valves might also be butterfly-type valves in which the valve element would be continuously rotated from a closed position, when selectively activated by the web edge detector, to supply intermittent short bursts of air through the edge-guiding discharge outlets.

Preferably, the web edge detection device is one which does not physically contact the web, such as photo-electric cells adjustably positionable at one or both side edges of the web to sense the lateral position of the same; however, certain mechanical devices which engage the web might be employed, provided they do not displace or disrupt the web in its lateral displacement by the intermittently directed air streams.

Figure 4:
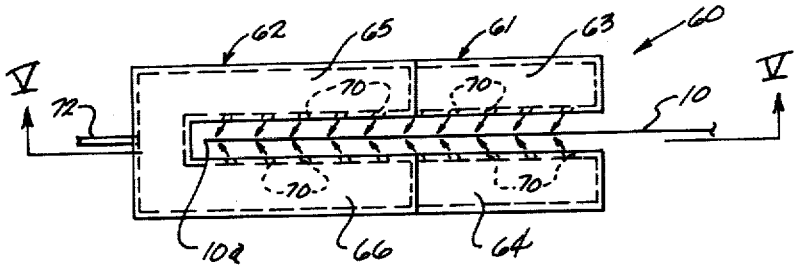
FIG. 4 is a top view of a modified form of pressurized fluid manifold for smoothing and laterally guiding the web during its travel to point of collection.
Figure 5:
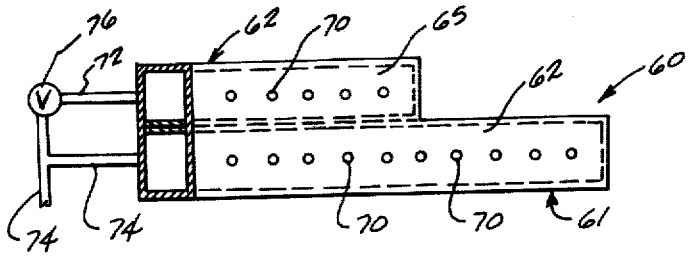
FIG. 5 is a sectional view of the manifold of FIG. 4, taken along line V—V and looking in the direction of the arrows.

FIGS. 4 and 5 illustrate a modified form of construction of the fluid pressure manifold system of the present invention wherein the smoothing and edge-guiding manifolds at each side edge portion of the web may be combined into a single housing or unit, with two of such units being employed at opposite side edge portions of the web path to smooth and guide the web, as hereinbefore described. As seen in FIG. 4, which is a top schematic plan view looking down on one of the units as it would be arranged about a side edge portion of a vertical web path, each unit comprises a generally U-shaped housing 60 which straddles the edge portion of the web 10 and is comprised of first and second manifold compartments 61, 62. Manifold compartment 61, which serves as the web spreading manifold of the unit, has parallel spaced, elongate manifold sections 63, 64. Manifold compartment 62 which serves as the edge-guiding manifold, has corresponding parallel, spaced shorter manifold sections 65, 66. The opposing walls of the pairs of sections of each of the manifold compartments 61, 62 have a plurality of fluid discharge outlets 70 (FIGS. 4 and 5) which are directed at a common angle of approximately 45° transverse to the direction of movement of the web 10 and toward the side edge 10*a* thereof. The two housing compartments 61, 62 communicate by suitable conduits 72, 74 with a source of pressurized air, and a flow control valve 76 is provided in conduit 72 to control supply of air to the shorter manifold compartment 62 for edge guidance of the web in response to web edge sensing means, such as photoelectric cells as illustrated in the embodiment of FIGS. 1 and 2.

That which is claimed is:

1. Apparatus for guiding a web of material during its longitudinal movement comprising means for supporting an indefinite length of web material for movement in a longitudinal path of travel; fluid pressure means positioned adjacent the path of travel of the web for intermittently directing pressurized fluid laterally across the surface of the web selectively toward one or the other of the side edges thereof to move the web laterally in its longitudinal path of travel; means positioned adjacent the path of travel of the web for detecting the lateral position of the web and for activating said fluid pressure means to selectively move the web laterally with respect to its longitudinal path of travel; said means for supporting the web for movement includes means for guiding the web in a substantially vertical path of travel past said fluid pressure means while maintaining the web in a free-hanging, relaxed condition to facilitate lateral movement of the web by said fluid directed therefrom; said detecting means comprises sensing means for detecting the position of the edge of the web without mechanical contact therewith, and said fluid pressure means includes valve means operatively associated therewith for selectively controlling the flow of pressurized fluid from said fluid pressure means toward one or the other of the side edges of the web in response to said sensing means.

2. Apparatus for guiding a web of material during its longitudinal movement comprising means for supporting an indefinite length of web material for movement in a longitudinal path of travel; fluid pressure means positioned adjacent the path of travel of the web for intermittently directing pressurized fluid laterally across the surface of the web selectively toward one or the other of the side edges thereof to move the web laterally in its longitudinal path of travel; means positioned adjacent the path of travel of the web for detecting the lateral position of the web and for activating said fluid pressure means to selectively move the web laterally with respect to its longitudinal path of travel; and wherein said fluid pressure means comprises fluid manifold means positioned adjacent at least each side edge portion of the path of travel of the web and including manifold portions disposed on opposite sides of the plane of the web having one or more fluid discharge outlets positioned to direct streams of fluid across opposite faces of the web toward the respective side edge thereof.

3. Apparatus for guiding a web of material during its longitudinal movement comprising means for supporting an indefinite length of web material for movement in a longitudinal path of travel; fluid pressure means positioned adjacent the path of travel of the web for intermittently directing pressurized fluid laterally across the surface of the web selectively toward one or the other of the side edges thereof to move the web laterally in its longitudinal path of travel; means positioned adjacent the path of travel of the web for detecting the lateral position of the web and for activating said fluid pressure means to selectively move the web laterally with respect to its longitudinal path of travel; second fluid pressure means positioned adjacent the path of travel of the web for continuously directing one or more streams of pressurized fluid outwardly of a central portion of the surface of the web simultaneously toward both side edges thereof to spread and smooth the web during its movement along said path of travel; and wherein said second fluid pressure means comprises a pair of elongate fluid pressure manifolds extending across the web path of travel respectively on opposite sides of the plane of the web, each of said manifolds including a plurality of fluid discharge outlets positioned to direct fluid in a plurality of streams outwardly of the central portion of the web and across the adjacent face of the web toward opposite side edges thereof to spread and smooth the web during its longitudinal movement.

4. Apparatus as defined in claim 3 wherein said second fluid pressure means are located upstream of said first mentioned fluid pressure means in the path of travel of the web.

5. Apparatus for smoothing and guiding a web of material during its longitudinal movement comprising means for supporting an indefinite length of web material for movement in a longitudinal path of travel; first fluid pressure means disposed adjacent the path of travel of the web for continuously directing streams of pressurized fluid outwardly of a central portion of the surface of the web toward side edges thereof to smooth the web during its movement along the path; second fluid pressure means disposed adjacent the path of travel of the web for intermittently directing a stream of pressurized fluid across the surface of the web selectively toward one or the other of the side edges thereof to move the web laterally during its movement along said path of travel; and means positioned adjacent the web path of travel for detecting the position of the edge of the web and for selectively activating said second fluid pressure means to move the web laterally in its path of travel and guide the same.

6. Apparatus as defined in claim 5 wherein said second fluid pressure means is disposed downstream in the path of travel of the web from said first fluid pressure means, and wherein said detecting means is positioned downstream of the path of travel of the web from said second fluid pressure means.

7. Apparatus as defined in claim 6 wherein said means for supporting the web for movement includes means for supporting the web for movement in a generally vertical direction past said first and second fluid pressure means.

8. A method of smoothing and guiding a web of material during its longitudinal movement comprising the steps of directing an indefinite length web of material in a longitudinal path of travel while maintaining the web in a relaxed free-hanging condition, continuously directing streams of pressurized fluid outwardly of a central portion of the web and toward opposite side edges of the web to smooth the same, and intermittently directing pressurized streams of fluid across the surface of the web toward one or the other side edges of the web to laterally displace the web relative to its longitudinal path of movement in response to web edge detecting means.

9. A method as defined in claim 8 wherein the web is directed in a vertical longitudinal path of travel during contact of its surface by said pressurized fluid streams.

10. A method as defined in claim 9 wherein the web is contacted by fluid streams directed against opposite opposed surfaces of the web to smooth and laterally displace the web relative to its longitudinal path of movment.

11. A method as defined in claim 10 wherein the edge of the web is detected by sensing the position of the edge of the web without contact with the web's surface.

12. Apparatus for smoothing and guiding a web of material during its longitudinal movement comprising means for supporting an indefinite length web of material for upward movement in a vertical path of travel while permitting the web to hang freely in said path during its upward movement, first pressurized fluid directing means located adjacent the vertical path of travel for continuously directing streams of pressurized fluid across the surface of the moving web outwardly of a central portion thereof toward the opposite side edges of the web to smooth the same, and second pressurized fluid directing means adjacent the path of travel for intermittently directing one or more streams of pressurized fluid across the surface of the web selectively toward one or toward the other of the side edges thereof to laterally move the web relative to its longitudinal path of movement, and means adjacent the path of movement of the web for detecting the lateral position of the web and for activating said intermittent fluid directing means in response thereto.

13. Apparatus as defined in claim 12 wherein said first pressurized fluid directing means comprises a pair of elongate fluid manifolds having a plurality of fluid discharge outlets and disposed respectively on opposite sides of the path of travel of the web with their respectively outlets directed toward opposite faces of the web to continuously direct streams of pressurized fluid across said surfaces outwardly of a central portion thereof toward opposite side edges of the web to smooth the same.

14. Apparatus as defined in claim 12 wherein said second pressurized fluid directing means comprises a fluid manifold means positioned adjacent each side edge portion of the web path of travel and having a plurality of outlets disposed on opposite sides of the plane of the web for directing pressurized fluid streams across opposite face portions of the web and outwardly toward the side edges in response to activation by said detecting means.

15. Apparatus as defined in claim 14 wherein said second pressurized fluid directing means includes valve means associated with each of said manifold means thereof for intermittently supplying pressurized fluid thereto for discharge through said outlets in response to activation by said detecting means.

16. Apparatus as defined in claim 15 wherein said means for detecting the lateral position of the web comprises photoelectric means for sensing a side edge portion of the web and for selectively activating one or the other of said valve means in response to a predetermined lateral displacement of the side edge of the web during its longitudinal movement along said path of travel.

* * * * *